US008197042B2

(12) United States Patent
Akiyama

(10) Patent No.: US 8,197,042 B2
(45) Date of Patent: Jun. 12, 2012

(54) DETACHABLE STRUCTURE FOR INK CARTRIDGE

(75) Inventor: Tomoyuki Akiyama, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 337 days.

(21) Appl. No.: 12/585,594

(22) Filed: Sep. 18, 2009

(65) Prior Publication Data

US 2010/0073442 A1 Mar. 25, 2010

(30) Foreign Application Priority Data

Sep. 19, 2008 (JP) ..... P2008-241737

(51) Int. Cl.
*B41J 2/175* (2006.01)

(52) U.S. Cl. ..... 347/85

(58) Field of Classification Search ..... 347/49, 347/84, 85, 86
See application file for complete search history.

(56) References Cited

U.S. PATENT DOCUMENTS 6,155,457 A * 12/2000 Landa et al. ..... 222/94
6,863,388 B2 * 3/2005 Seino et al. ..... 347/86
7,147,309 B2 * 12/2006 Sakai et al. ..... 347/85
7,753,505 B2 * 7/2010 Sugahara et al. ..... 347/86
8,025,372 B2 * 9/2011 Umeda et al. ..... 347/85

FOREIGN PATENT DOCUMENTS

JP 2007-290349 A 11/2007

* cited by examiner

*Primary Examiner* — Anh T. N. Vo

(74) *Attorney, Agent, or Firm* — The Nath Law Group; Jerald L. Meyer; Stanley N. Protigal

(57) ABSTRACT

A detachable structure for an ink cartridge includes a supply port, a joint section, an insertion rod and an anti-outflow member. The port is provided in the cartridge. The stopper is provided in the port and urged outward to close the port. The joint section is provided in a printer and coupled with the port. The joint section has an ink flow path that communicates with the port while the port is coupled. The insertion rod is provided in the joint section for pushing the stopper inward to communicate the ink flow path with the port while the port is coupled. The anti-outflow member is slidably provided in the joint section. The anti-outflow member is urged outward and slides along the insertion rod when the port is being inserted into the joint section. According to the structure, ink leakage on attaching or detaching of the cartridge can be prevented.

10 Claims, 10 Drawing Sheets

DETACHABLE STRUCTURE FOR INK CARTRIDGE

BACKGROUND OF THE INVENTION

1. Field of the Invention

The present invention relates to a detachable structure for an ink cartridge in a printer.

2. Description of Related Art

With respect to an inkjet printer, printing speed becomes higher and an image size to be printed becomes larger in recent days and thereby ink consumption increases. Therefore, larger ink supply amount from an ink cartridge to an inkjet printer is required. In a conventional ink supply method for an inkjet printer, an ink supply needle is inserted into an ink container in an ink cartridge in order to extract ink. However, ink flow amount is small in the conventional method and thereby the conventional method cannot meet the requirement of larger ink supply amount due to higher printing speed and larger image size. Therefore, a joint mechanism with an inner stopper and an O-ring is used to make supply amount larger in recent days.

Compared with ink supplying through the ink supply needle, ink dripping from a joint tends to increase according to the above-mentioned joint mechanism. The ink dripping onto the ink cartridge, the inside of the printer and so on may taint user's hands and clothes or an attachment section of the ink cartridge in the printer. Especially, ink tends to drip off in a detachable structure of an ink cartridge as shown in FIGS. 11A and 11B.

FIG. 11A shows a coupled state of an ink supply port 230 of a conventional ink cartridge and a cartridge holder 310 of a printer. An inner stopper 231 provided in the ink supply port 230 is pushed inward by an insertion rod 312 provided on the cartridge holder 310 so as to open an ink flow path 230*a* communicating with an ink flow path 311 in the cartridge holder 310. Ink contained within the ink container 220 is supplied to the ink flow path 311 through the ink flow path 230*a* within the supply port 230.

On the other hand, FIG. 11B shows an uncoupled state of the ink supply port 230 and the cartridge holder 310. Ink remaining in an inner space 310*a* of the cartridge holder 310 cannot be held within the inner space only by an O-ring 314 provided in a joint section and thereby flow out from the joint section.

A structure for solving the above-mentioned issue is proposed in Japanese patent Application Laid-open No. 2007-290349 (Patent Document 1), for example. In an ink cartridge of the structure includes an ink containing section and an ink supplying section. Pins are provided on a surface of the ink cartridge on which an ink supply port is also provided. Each of the pins is extended outward from an opening hole of the ink supply port. Therefore, ink dripping from the ink supply port is held between the pins due to its capillary force.

SUMMARY OF THE INVENTION

The above-mentioned structure disclosed in the Patent Document 1 does not taint an attachment section of the ink cartridge in the printer. However, the above-mentioned structure only brings a function for holding the dripping ink and cannot reduce or prevent ink dripping. Therefore, the ink that dripped may taint user's hands and clothes when the ink cartridge is attached or detached. In a case where the ink cartridge is attached or detached in a horizontal direction, dripping amount of ink may increase. It is desired to develop a structure of an ink cartridge that can prevent ink leakage that flowed out from an opening into which an ink supply unit of a printer is inserted or from which the ink supply unit is pulled out when the ink cartridge is attached or detached.

The present invention has been achieved in order to solve the above problems and an object of the present invention is to provide a detachable structure for an ink cartridge that can prevent ink leakage from a connecting section of the ink cartridge when the ink cartridge is attached-to or detached-from a printer such as an inkjet type printer.

An aspect of the present invention provides a detachable structure for an ink cartridge which is detachable with a printer. The structure includes an ink supply port, an inner stopper, a joint section, an insertion rod and an anti-outflow member. The ink supply port is provided in the ink cartridge to supply ink to the printer. The inner stopper is provided in the ink supply port. The inner stopper is pressed outward due to an inner pressure of the ink cartridge so as to close the ink supply port. The joint section is provided in the printer. The joint section is coupled with the ink supply port so as to enfold the ink supply port and has an ink flow path in its inside. The ink flow path communicates with the ink supply port while the ink supply port is coupled with the joint section. The insertion rod is provided in the joint section to push the inner stopper into an inside of the ink supply port so as to communicate the ink flow path with the ink supply port while the ink supply port is coupled with the joint section. The anti-outflow member is slidably provided in the joint section. The anti-outflow member is urged toward an outside of the joint section and slides along the insertion rod when the ink supply port is being inserted into the joint section.

According to the aspect of the present invention, the anti-outflow member that contacted with the supply port slides outward when the ink cartridge is being detached from the printer. Therefore, ink leakage from the joint section can be prevented by the anti-outflow member and ink can be held within the joint section. Since the insertion rod functions to open the ink supply port by pushing the inner stopper and to guide the anti-outflow member sliding, ink can be firmly guided to flow into the joint section through the ink supply port and ink leakage from the joint section after detaching the ink cartridge can be prevented firmly.

It is preferable that the anti-outflow member includes a plate having an outer shape corresponding to an inner shape of the ink flow path and a plurality of through holes formed on the plate. In this case, it can be done by ink flowing through the through holes to supply ink from the ink cartridge to the printer. In addition, ink within the joint section can be held due to surface tension of the ink after the ink cartridge is detached from the printer.

It is preferable that the anti-outflow member includes a plate having an outer shape corresponding to an inner shape of the ink flow path and an insertion hole having an inner diameter larger than the an outer diameter of the insertion rod to make an ink flow path between the plate and the insertion rod. In this case, it can be done by ink flowing through the insertion hole to supply ink from the ink cartridge to the printer. Since the insertion hole is made larger than the outer diameter of the insertion rod and the insertion hole is located at the center of the plate, ink flow can be ensured on supplying ink and ink can be supplied flawlessly. In addition, ink within the joint section can be held due to surface tension of the ink after the ink cartridge is detached from the printer.

Alternatively, it is preferable that the anti-outflow member includes a plate having an outer shape corresponding to an inner shape of the ink flow path, a plurality of through holes provided on an outer circumference of the plate formed on the plate and a plurality of bumps provided on one surface of the plate that faces the ink supply port. In this case, it can be done by ink flowing through the through holes to supply ink from the ink cartridge to the printer. Since a gap can be made as an ink flow path between the inner stopper (the ink supply port) and the plate due to presence of the bumps, ink flow through the ink flow path can be ensured on supplying ink and ink can be supplied flawlessly. Further, ink within the joint section can be held due to surface tension of the ink after the ink cartridge is detached from the printer.

Alternatively, it is preferable that the anti-outflow member includes a plate having an outer shape corresponding to an inner shape of the ink flow path and being made of cavernous material that is ink-permeable. In this case, it can be done by ink flowing through the ink-permeable cavernous material to supply ink from the ink cartridge to the printer. Since the ink-permeable cavernous material constitutes a large (or an entire) portion of the anti-outflow member, ink flow can be ensured on supplying ink and ink can be supplied flawlessly. Further, ink within the joint section can be held due to surface tension of the ink after the ink cartridge is detached from the printer.

As described above, according to the structure of the present invention, ink leakage from a connecting section of the ink cartridge can be prevented when the ink cartridge is attached-to or detached-from a printer such as an inkjet type printer.

DETAILED DESCRIPTION OF THE EMBODIMENTS

General Configuration of Printer

One embodiment of a detachable structure for an ink cartridge according to the present invention will be explained with reference to the drawings. A printer 100 having the detachable structure is an inkjet type color line printer. The printer 100 includes a plurality of ink heads each has a number of nozzles. Printing is done line by line by ejecting black and/or color ink drops from the nozzles onto a printing paper (sheet) on a feeding belt so as to overlap images each other.

Four of the four ink heads are aligned and provided for yellow (Y), magenta (M), cyan (C) and black (K) inks for forming color images so as to overlap images formed by the respective ink heads. A processing unit 330 is provided within the printer 100. The processing unit 330 controls the above-mentioned printing processes by the ink heads, a drive control of a feed mechanism, a supply control of inks supplied from ink cartridges 200 and so on.

The processing unit 330 is a processing module composed of processors such as a CPU, a DSP (Digital Signal Processor) and so on, memories, other hardwares such as electronic circuits, softwares such as programs implementing functions of the above-mentioned components, or combinations thereof. The processing unit 330 virtually builds various functional modules by arbitrarily loading and executing programs. The processing unit 330 also executes processes of image data, controls of components' operations and various processes against user's operations using the built functional modules. Further, an operation panel 340 is connected to the processing unit 330. User's instructions and setting operations can be accepted via the operation panel 340.

Figure 1A:
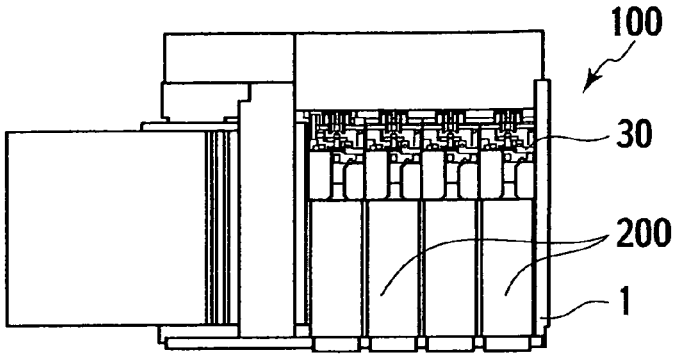
FIG. 1A is a plan view of a printer having a detachable structure for an ink cartridge according to an embodiment of the present invention.
Figure 1B:
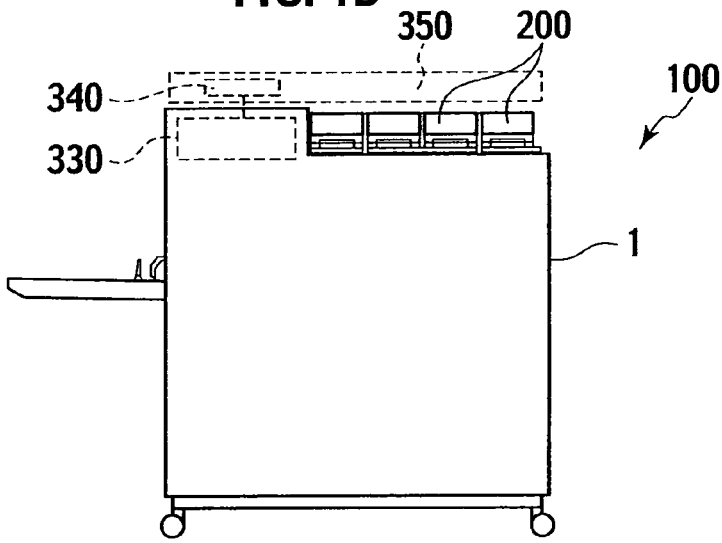
FIG. 1B is a front view of the printer having the detachable structure according to an embodiment of the present invention.
Figure 1C:
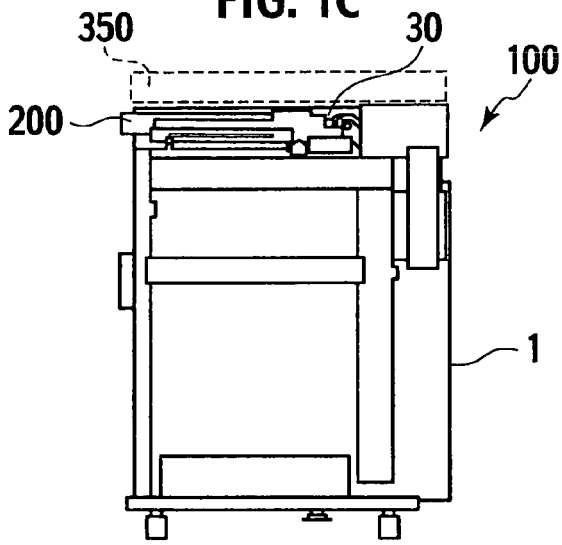
FIG. 1C is a right side view of the printer having the detachable structure according to an embodiment of the present invention.

As shown in FIG. 1A, a cartridge attaching mechanism 30 for the ink cartridges 200 is provided in the printer 100. As shown in FIGS. 1A and 1B, the ink cartridges 200 are attached onto the cartridge attaching mechanism 30 from a front side of the printer 100. The ink cartridges 200 for the above-mentioned colors are installed onto the cartridge attaching mechanism 30 with being aligned. In addition, an upper unit 350 is provided so as to cover the cartridge attaching mechanism 30. The ink cartridges 200 are installed by being horizontally inserted into spaces between a bottom face of the upper unit 350 and a top face of a main body 1 of the printer 100. The operation panel 340, a sheet feeder and so on are provided on the upper unit 350.

Figure 2A:
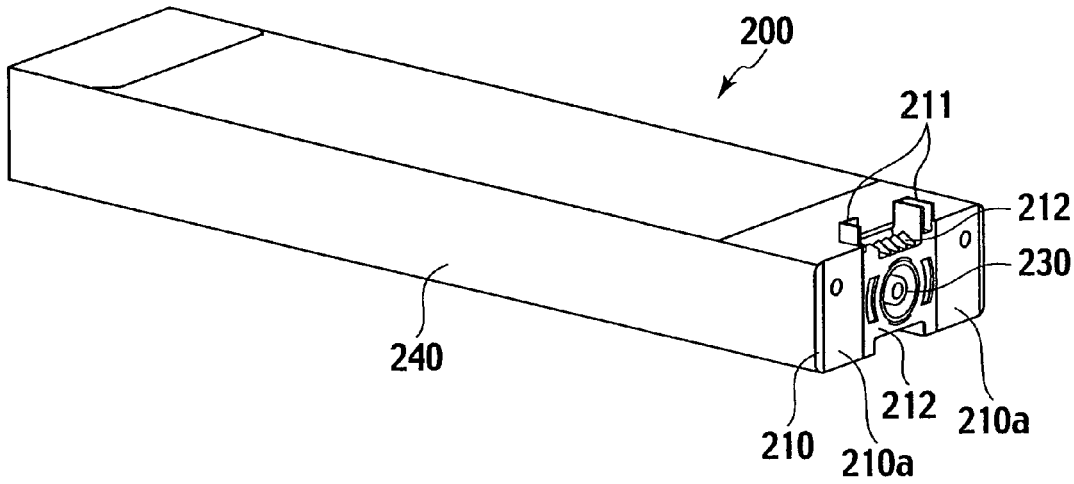
FIG. 2A is a perspective view showing an appearance of the ink cartridge.
Figure 3:
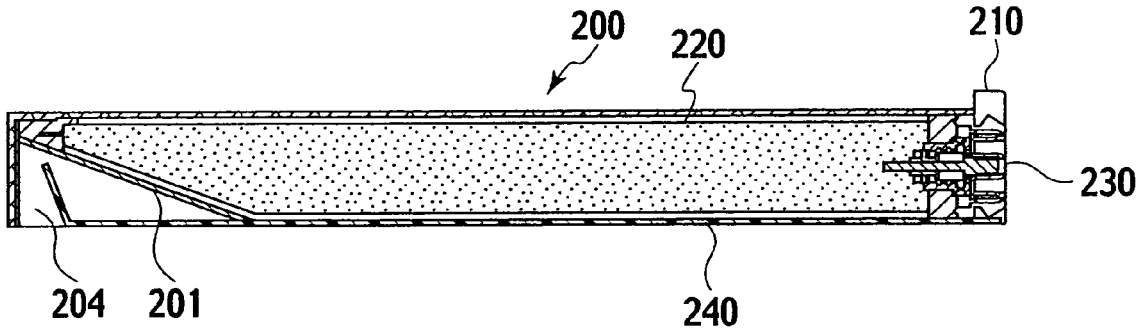
FIG. 3 is a cross-sectional view of the ink cartridge.

As shown in FIG. 2A, each of the ink cartridges 200 has a brick-like long shape and is horizontally attached-to or detached-from the printer 100. As shown in FIG. 3, each of the ink cartridges 200 mainly composed of an ink container 220 and an outer package 240. The ink container 220 is filled with ink and inserted within the outer package 240.

Figure 2B:
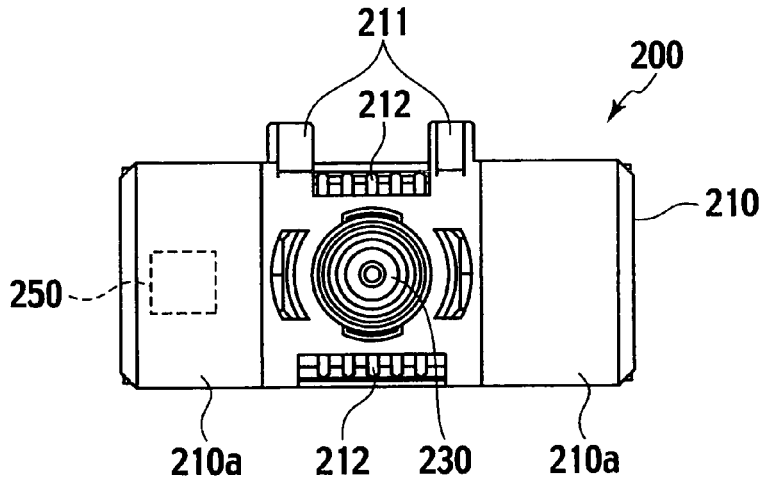
FIG. 2B is a side view of the ink cartridge showing its connecting section that is to be connected with the printer.

The outer package 240 is a tubular casing that has a rectangular cross sectional shape. As shown in FIG. 2B, a horizontal-to-vertical ratio of the outer package 240 in the present embodiment is about 2:1. The horizontal-to-vertical ratio is a ratio of a lateral-direction side parallel to a horizontal plane including an insertion direction to a longitudinal-direction side perpendicular to the horizontal plane. In addition, a connecting plate 210 is attached on one side plane of the outer package 240 and is to be connected the cartridge attaching mechanism 30 of the printer 100. The connecting plate 210 is made of hard material such as resin and metal. The connecting plate 210 is a contacted plane that is to be contacted with the cartridge attaching mechanism 30.

The connecting plate 210 has an ink supply port 230 on its center. Contacting plates 210*a* are provided on right and left sides of the supply port 230. The contacting plates 210*a* are made of resin, metal or the like and embedded on the one side plane of the tubular outer package 240. The contacting plates 210*a* are fixed on the outer package 240 by adhesive paper labels.

Connectors 212 are provided on upper and lower sides of the supply port 230 (on upper and lower centers of the connecting plate 210). The connectors 212 are to be held by holding units provided on the printer 100. Triangular ribs are aligned on the connectors 212. The triangular ribs of the connectors 212 are snapped into slits or grooves provided on the holding units and then held due to elastic forces of the holding units.

A pair of tabs 211 is projected upward from an upper edge of the connecting plate 210. The pair of tabs 211 is provided only on one side in order to avoid confusion of upper and bottom sides on attaching the ink cartridge 200 onto the printer 100. In addition, the tabs 211 are detected by a detecting sensor(s) provided in the printer 100 while the ink cartridge 200 is installed in the printer 100. Specifically, the detecting sensor is a light-receiving sensor and detects a presence of an object when light is interrupted by the object. The tabs 211 approach toward the light-receiving sensor while the ink cartridge 200 is installed and then completion of the instillation is detected when the light-receiving is interrupted.

Further, a communication tag 250 is attached on the connecting plate 210 to communicate wirelessly with a receiver provided in the printer 100. The communication tag 250 generates an electrical power in its inside due to radio waves received from the receiver. The communication tag 250 reads data out form its memory or writes data into the memory using the electrical power and sends/receives data via its antenna. In the present embodiment, ink color, oil/water-base of ink, attach/detach frequency or the like is stored in the memory. A contactless communication interface starts to communicate when the completion of the instillation on the cartridge attaching mechanism 30 is detected and data stored in the communication tag 250 are sent to the printer 100 (or data stored in the printer 100 are sent to the ink cartridge 200).

On the other hand, the outer package 240 is made of soft material such as paper and woody material and can be cut or bent. In the present embodiment, a recess 204 is provided on a bottom of the outer package 240 and positioned a counter side against the connecting plate 210, as shown in FIG. 3. The recess 204 functions as a handle when pulling the ink cartridge 200. In the present embodiment, the recess 204 is a hole that penetrates the bottom of the outer package 240 and communicates with an inner space of the outer package 240. The hole is formed by cutting around a part of the outer package 240 and bending the part inward.

A partition 201 is provided in the outer package 240 to form an inner space in which a flat end of the ink container 220 is held. The inner space formed by the partition 201 has a triangular longitudinal cross-sectional shape, as shown in FIG. 3 and located inward (behind) the recess 204. Note that the bent part for forming the recess 204 is located within the inner space.

Figure 4A:
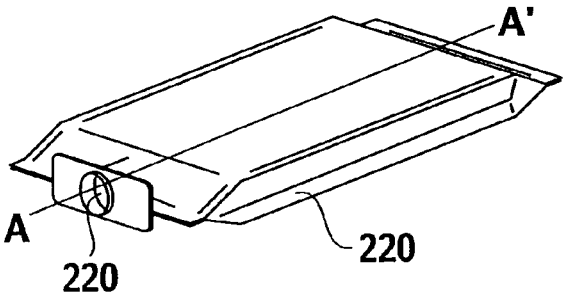
FIG. 4A is a perspective view showing an ink container of the ink cartridge.
Figure 4B:
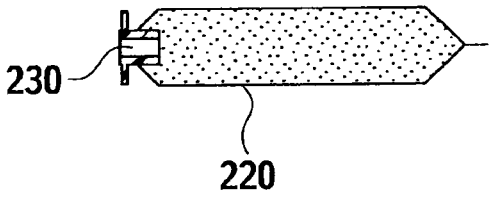
FIG. 4B is a cross-sectional view of the ink container.
Figure 4C:
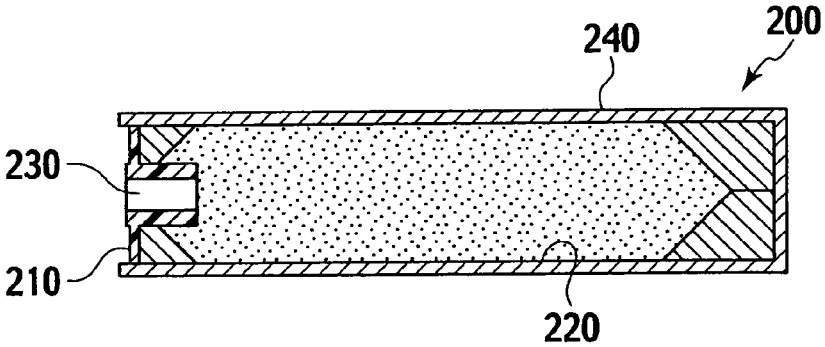
FIG. 4C is a cross-sectional view of the ink container that is set in the cartridge.

As shown in FIG. 4A, the ink container 220 is a bag that is filled with ink. In the present embodiment, the ink container 220 is made by heat-adhering four films so as to form its four side faces, respectively. Fold lines are made at its four adhesion sides due to the heat-adhesion. The ink container 220 has a rectangular cross-sectional shape when it is filled with ink. The rectangular cross-sectional shape of the ink container 220 corresponds to the rectangular cross-sectional inner shape of the outer package 240.

In addition, both ends of the ink container 220 at which its upper and bottom films are heat-adhered forms the flat ends. The flat ends are parallel to the horizontal plane. Further, each side face of the ink container 220 has a bending line. Therefore, the ink container 220 will become flat by bending its side faces along the bending lines, as the ink contained therein will be expended. Finally, the ink container 220 will become a flat shape that includes the both flat ends and the bending lines.

Furthermore, the ink supply port 230 is attached on one end of the ink container 220. The ink supply port 230 is mounted at the center of the above-mentioned connecting plate 210 to form a part of the connecting plate 210 under a state where the ink container 220 is held within the outer package 240. Under the above-mentioned held state, the ink supply port 230 is projected in an insertion direction in which the ink container 220 is inserted into the outer package 240. The ink supply port 230 will be attached-to or detached-from a cartridge holder 310 of the printer 100. The cartridge holder 310 is provided for each of the ink cartridge 200.

Figure 5A:
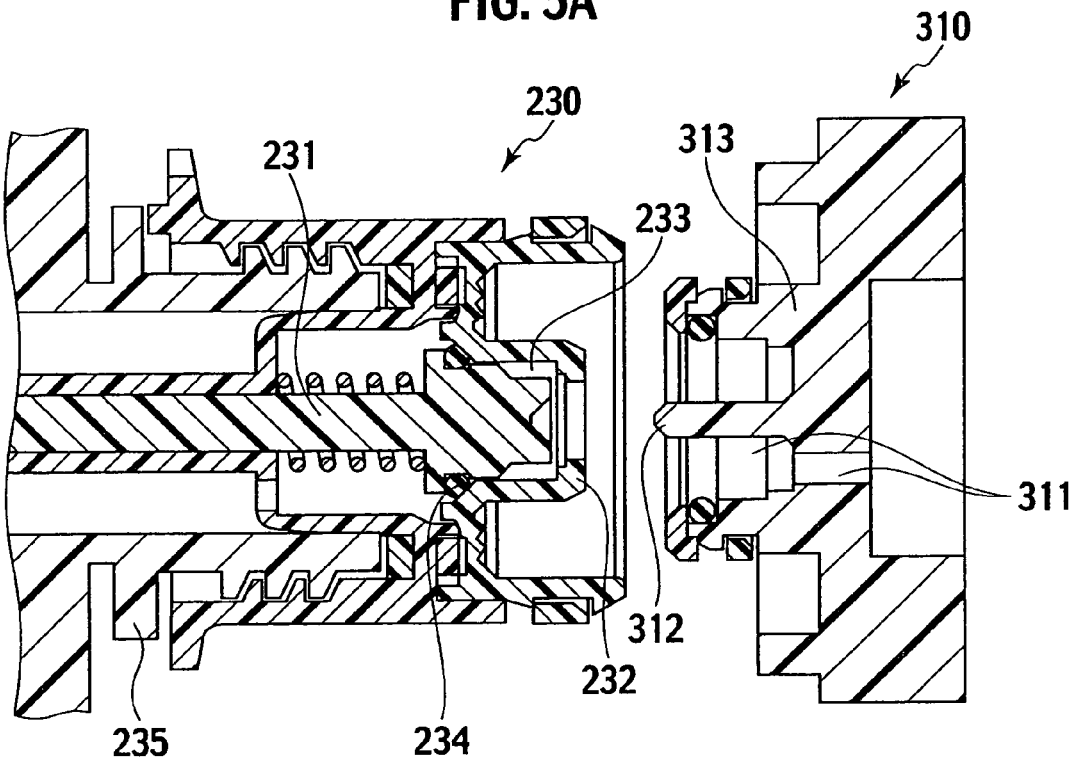
FIG. 5A is a cross-sectional view of the detachable structure (detached state)
Figure 5B:
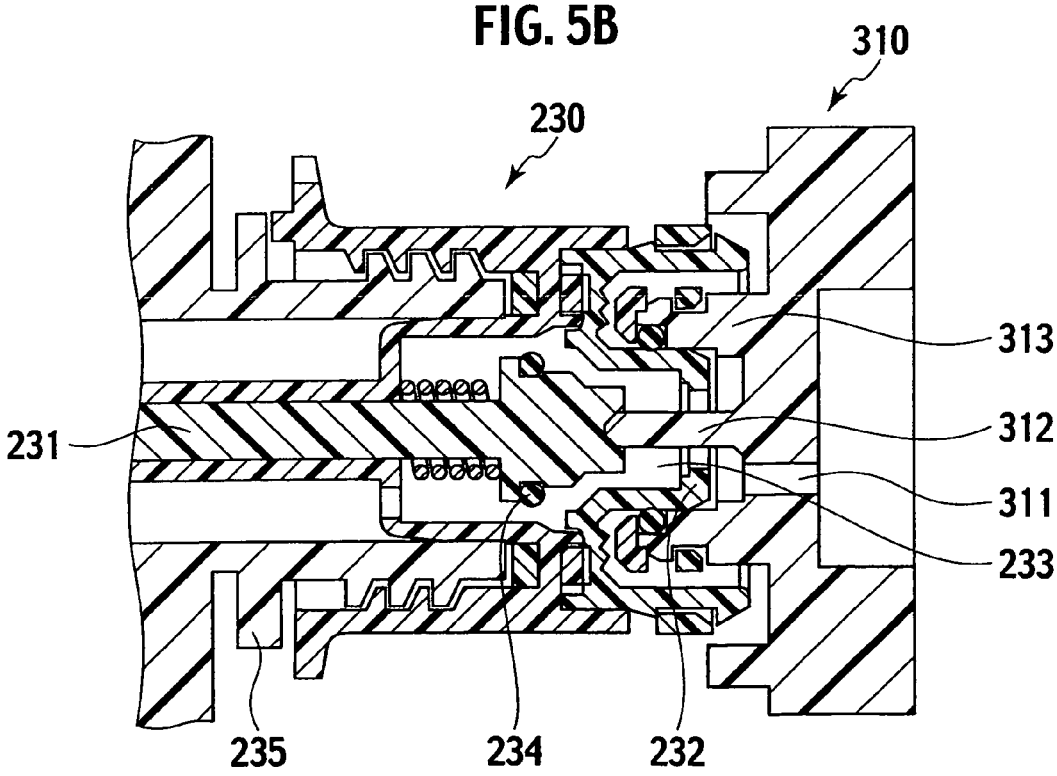
FIG. 5B is a cross-sectional view of the detachable structure (attached state)

As shown in FIGS. 5A and 5B, the ink supply port 230 is mainly composed of a joint section 232 and the inner stopper 231. The inner stopper 231 is pressed outward by an inner pressure from the inside of the joint section 232 to close the ink supply port 230. Note that an after-mentioned anti-outflow member 320 is not shown in FIGS. 5A and 5B but the anti-outflow member 320 will be explained later in detail with reference to FIGS. 7A to 10B.

The ink supply port composes the detachable structure that is to be coupled with the cartridge holder 310 of the printer 100. According to the detachable structure, the ink cartridge 200 and the printer 100 is connected each other and then ink is supplied from the ink cartridge 200 to the printer 100.

The cartridge holder 310 includes a joint section 313 that is to be coupled with the joint section 232 of the supply port 230 so as to enfold the joint section 232 therein. An ink path 311 is provided within the joint section 313. The ink path 311 communicates with the ink supply port 230 of the ink cartridge 200 while the joint sections 230 and 313 are coupled with each other The insertion rod 312 is provided along (within) the ink path 311 of the cartridge holder 310. The insertion rod 312 is projected toward the ink supply port 230 and inserted into the joint section 232 under the coupling state of the ink supply port 230 and the cartridge holder 310 to push the inner stopper 231 into the joint section 232. When the inner stopper 231 is pushed into the joint section 232, an ink flow path 233 that is communicated with the ink path 311 is opened through the inside of the joint section 232 of the ink supply port 230.

According to the above described detachable structure of the ink cartridge, supplying ink from the ink cartridge 200 installed on the main body 1 of the printer 100 is achieved by the detachable structure that is composed of the ink supply port 230 and the cartridge holder 310.

Figure 6:
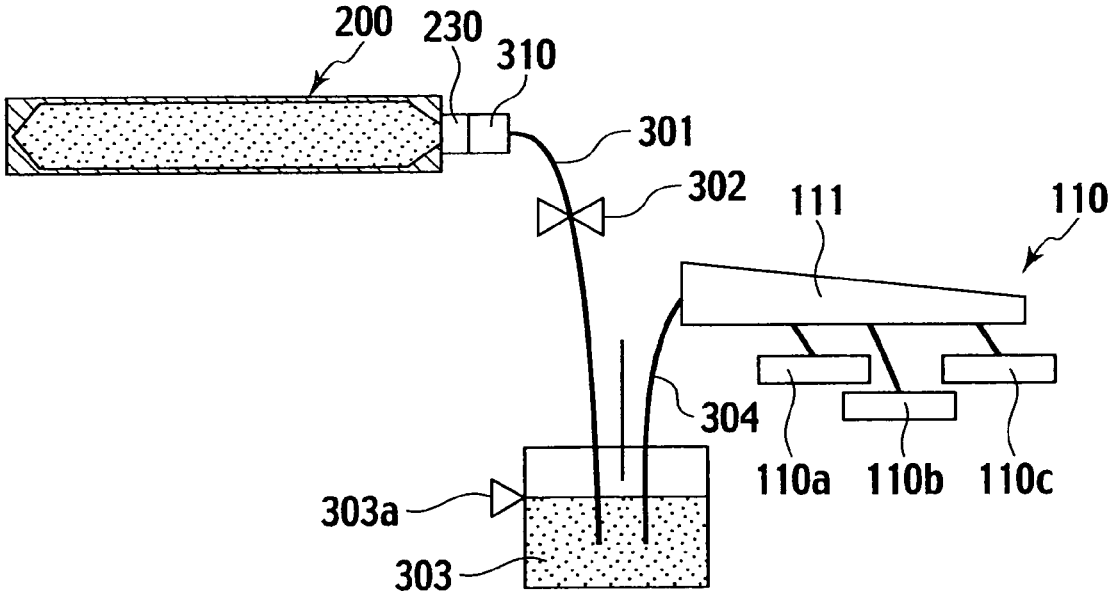
FIG. 6 is a schematic diagram showing an ink supply system in the embodiment.

As shown in FIG. 6, ink from the ink cartridge 200 is introduced into an ink tank 303 (also called as a reserver) through an ink supply path 301. An electromagnetic valve 302 is provided on the ink supply path 301 to open/close a flow path of the ink supply path 301 and control a flow amount of the ink through the ink supply path 301. A fluid level sensor 303 is provided within the ink tank 303 to measure the introduced ink amount by sensing fluid level within the ink tank 303. Note that supplying ink from the ink cartridge 200 to the ink tank 303 is achieved due to a pressure difference between a pressure within the ink cartridge 200 installed at a high position and a pressure within the ink tank 303 provided at a low position.

The introduced ink into the ink tank 303 is delivered to a distributor 111 in a head unit 110 through a supply path 304 and then distributed to ink heads 110*a*, 110*b*, 110*c*, . . . by the distributor 111 so as to be served for printing processes. In addition, a temperature sensor (not shown) is provided within the distributor 111 to detect ink temperature. Therefore, the temperature of ink that is just supplied to the ink heads 110*a*, 110*b*, 110*c* . . . can be detected.

(Configuration of Detachable Structure for Ink Cartridge)

Figure 7A:
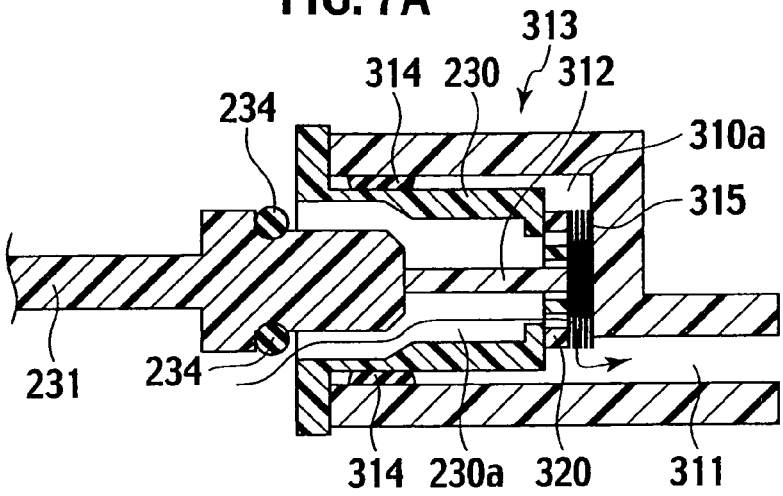
FIG. 7A to 7C are cross-sectional views showing behaviors of the detachable structure.
Figure 7B:
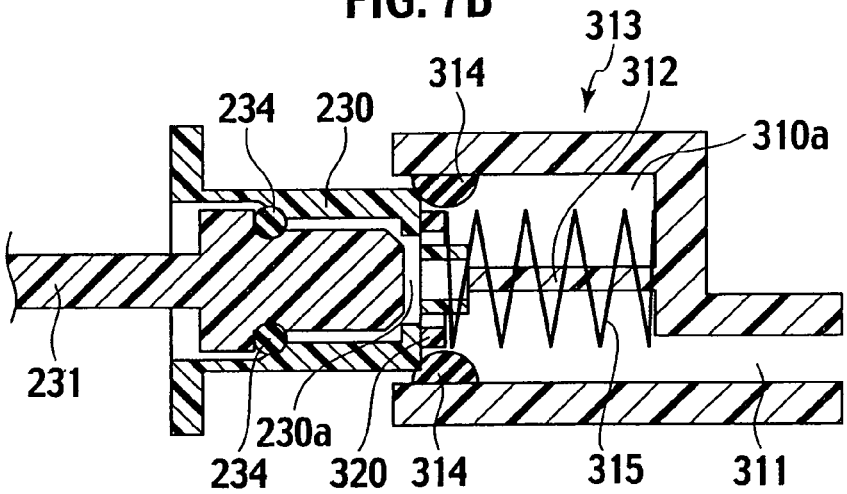
Figure 7C:
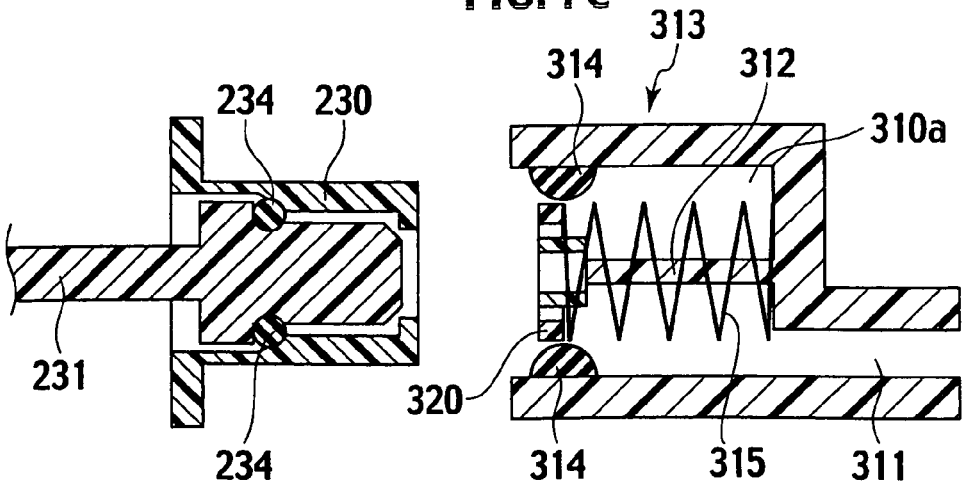

As shown in FIGS. 7A to 7C, the detachable structure in the ink cartridge 200 is embedded at the joint section 232 of the ink supply port 230 and includes the inner stopper 231 that is pressed outward due to the inner pressure of the joint section 232 to close the ink supply port 230.

On the other hand, the joint section 313 is provided in the cartridge holder 310. The joint section 313 is to be coupled with the joint section 232 of the supply port 230 so as to enfold the joint section 232 therein. The joint section 313 includes an inner space 310*a* and the ink path 311 within its inside. The inner space 310*a* communicates with the joint section 232 of the coupled ink supply port 230. The insertion rod 312 is provided within the joint section 313. The insertion rod 312 is inserted into the coupled ink supply port 230 to push the inner stopper 231 into the ink supply port 230. When the inner stopper 231 is pushed into the ink supply port 230, the ink flow path 233 (see FIGS. 5A and 5B) communicating with the ink path 311 of the joint section 313 is opened to the ink flow path 230*a* (see FIGS. 7A to 7C) through the inside of the joint section 232.

Figure 8A:
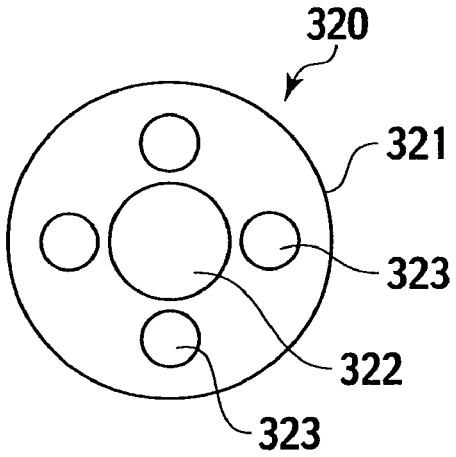
FIG. 8A is a front view showing an anti-outflow member in the embodiment.
Figure 8B:
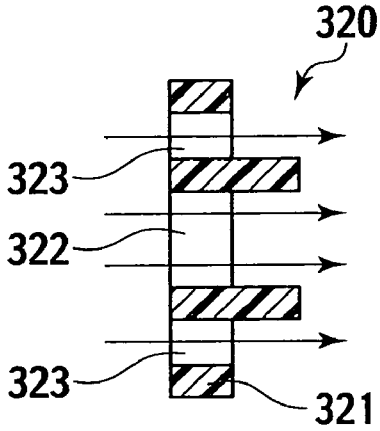
FIG. 8B is a cross-sectional view of the anti-outflow member.

Further, an anti-outflow member 320 is provided as a part of the detachable structure in the cartridge holder 310 (see FIGS. 7A to 7C). The anti-outflow member 320 is slidably coupled with the insertion rod 312 and urged by a spring 315 toward the outside of the joint section 313. The anti-outflow member 320 slides along the insertion rod 312 when the ink supply port 230 is being inserted into the cartridge holder 310. As shown in FIGS. 8A and 8B, the anti-outflow member 320 basically includes a circular plate 321 and through holes 322 and 323. A shape of the circular plate 321 corresponds to an inner shape of the inner space 310*a*. The through holes 322 and 323 are formed on the circular plate.

As shown in FIG. 7A, the inner stopper 231 is pushed into the ink supply port 230 by the insertion rod 312 so as to open the ink flow path 233 (see FIGS. 5A and 5B) that communicates with the ink path 311 through the inside of the ink supply port 230 while the ink supply port 230 is coupled with the cartridge holder 310. Therefore, ink contained within the ink container 220 is supplied to the ink flow path 311 through the ink flow path 230*a* within the supply port 230. Note that leakage of the ink within the inner space 310*a* is prevented by an O-ring 314 provided in the cartridge holder 310.

The anti-outflow member 320 slides toward the inside of the joint section 313 of the cartridge holder 310 with contacting onto the ink supply port 230 and repelling a force of the spring 315 when the ink supply port 230 is being inserted into the cartridge holder 310. After the ink supply port 230 is completely coupled with the cartridge holder 310, ink flowing out from the ink supply port 230 flows into the ink flow path 311 through the through holes 323 of the anti-outflow member 320 and the spring 315, as shown in FIG. 7A.

As shown in FIG. 7B, the ink supply port 230 of the ink cartridge 200 is released from the cartridge holder 300 in the printer 100 when the ink cartridge 200 is uncoupled. The anti-outflow member 320 slides outward with contacting onto the ink supply port 230 by the spring 315 until the ink supply port 230 is completely uncoupled from the cartridge holder 310.

After the ink supply port 230 is uncoupled, ink remains in the ink path 311, the inner space 310*a* and the ink flow path 230*a*. On the other hand, the inner stopper 231 is released from being pressed by the insertion rod 312 and then closes the ink supply port 230 due to the inner pressure from the inside of the ink cartridge 200. In addition, leakage of the ink within the ink cartridge 200 is prevented by a seal ring 234 provided around the inner stopper 231.

As shown in FIG. 7C, the anti-outflow member 320 is being urged by the spring 315 and positioned at the edge of the joint section 313 after the ink cartridge 200 is completely detached from the printer 100 (from the cartridge holder 300). In addition, leakage of the remaining ink within the ink path 311 and the inner space 310*a* is prevented by the O-ring 314 and the anti-outflow member 320. The gap between the O-ring 314 and the anti-outflow member 320 is sufficiently small and each inner diameter of the through holes 322 and 323 is also sufficiently small to keep the ink in the joint section 313. Therefore, the remaining ink is held within the joint section 313 and thereby prevented from flowing out from the cartridge holder 310.

On the other hand, since the inner stopper 231 of the ink supply port 230 is released from being pressed by the insertion rod 312, the ink supply port 230 is closed due to the inner pressure from the inside of the ink cartridge 200 and leakage of the remaining ink within the ink flow path 230*a* is further prevented by the seal ring 234.

The anti-outflow member 320 takes an above-mentioned configuration as shown in FIGS. 8A and 8B and may take other configurations as shown in FIGS. 9A, 9B and 10A, 10B. Note that arrows shown in FIGS. 8A to 10B indicate ink flows.

In the anti-outflow member 320 shown in FIG. 8A, the through hole 322 is formed at the center of the circular plate 321. Since the insertion rod 312 is to be inserted into the center through hole (insertion hole) 322, the inner diameter of the through hole 322 is made larger than an outer diameter of the insertion rod 312. In addition, the through holes 323 are formed around the center through hole 322.

Ink flows as shown by the arrows shown in FIG. 8B according to the configuration shown in FIG. 8A, so that the ink is supplied from the ink cartridge 200 to the printer 100 through the through holes 322 and 323. In addition, the remaining ink within ink path 311 and the inner space 310*a* is held by the through holes 322 and 323 due to its surface tension after detaching the ink cartridge 200, as described with reference to FIG. 7C. Therefore, leakage of the ink can be prevented.

Figure 9A:
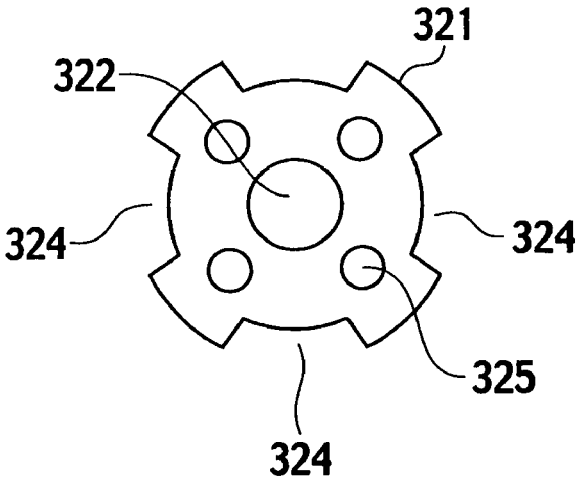
FIG. 9A is a front view showing a modified example of the anti-outflow member.
Figure 9B:
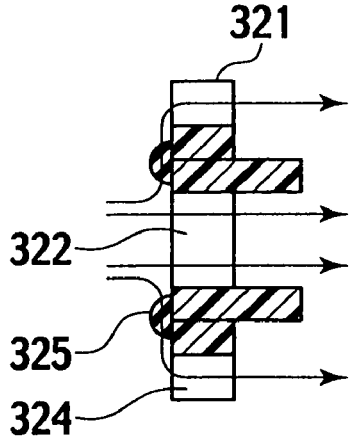
FIG. 9B is a cross-sectional view of the modified example of the anti-outflow member.

A modified example of the anti-outflow member 320 is shown in FIGS. 9A and 9B. As shown in FIG. 9A, through holes (cutouts) 324 are provided on an outer circumference of the circular plate 321. Also in this case, the center through hole 322 is formed similarly to the above-described anti-outflow member 320 shown in FIGS. 8A and 8B. In addition, bumps (bosses) 325 are provided on one surface of the circular plate 321. The one surface is to face the ink supply port 230.

Ink flows as shown by the arrows shown in FIG. 9B according to the configuration shown in FIG. 9A, so that the ink is supplied from the ink cartridge 200 to the printer 100 through the through holes 322 and 324. Since the bumps 325 are contacted onto the inner stopper 231 (or the joint section 232) under conditions as shown in FIGS. 7A and 7B, ink flow paths can be ensured between the anti-outflow member 320 and the inner stopper 231 (the joint section 232). In addition, the remaining ink within ink path 311 and the inner space 310*a* is held by the through holes 322 and 324 due to its surface tension after detaching the ink cartridge 200, under a condition as shown in FIG. 7C. Therefore, leakage of the ink can be prevented.

Figure 10A:
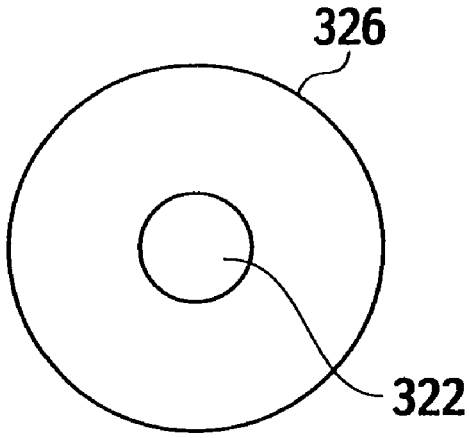
FIG. 10A is a front view showing another modified example of the anti-outflow member.
Figure 10B:
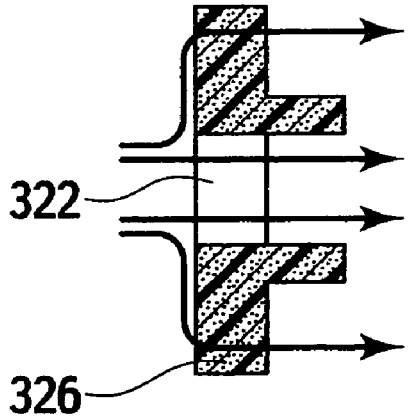
FIG. 10B is a cross-sectional view of the other modified example of the anti-outflow member.
Figure 11A:
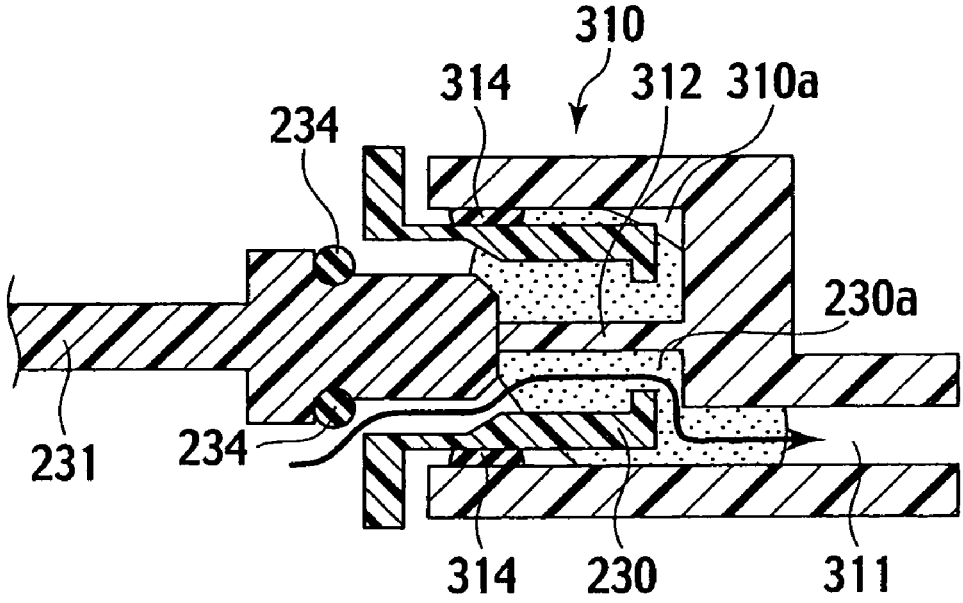
FIGS. 11A and 11B are cross-sectional views showing behaviors of a conventional detachable structure for an ink cartridge.
Figure 11B:
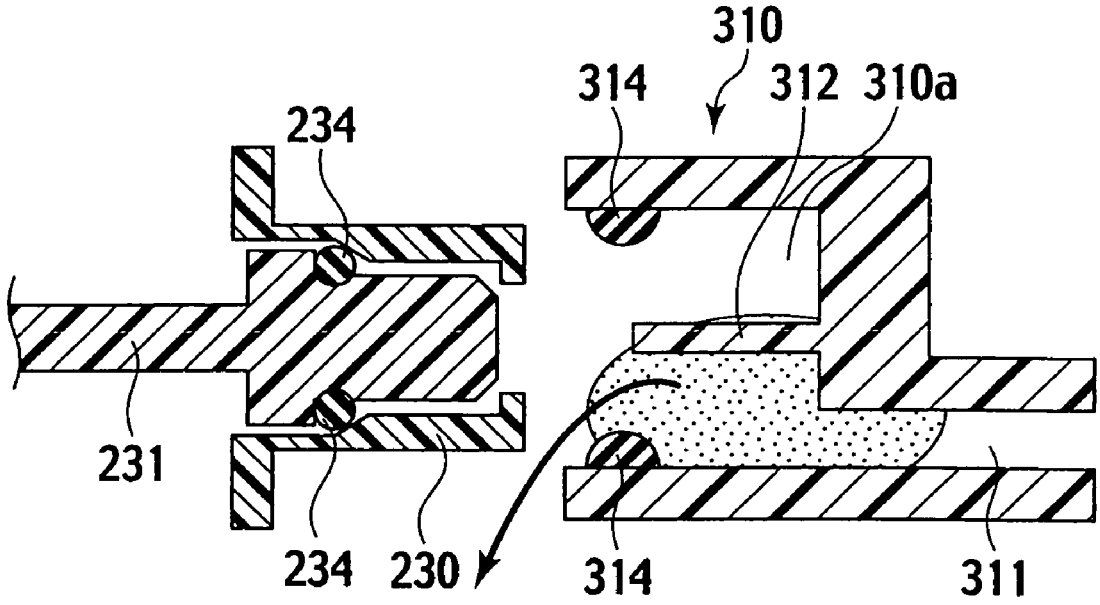

Another modified example of the anti-outflow member 320 is shown in FIGS. 10A and 10B. As shown in FIG. 10A, the circular plate 321 is made of cavernous material 326 that is ink-permeable. Note that no through holes 323 and 324 as shown in FIGS. 8A to 9B are not formed on the circular plate 321 in this modified example. Also in this case, the center through hole 322 is formed similarly to the above-described anti-outflow member 320 shown in FIGS. 8A to 9B. However, the inner diameter of the center through hole 322 in this modified example can be smaller than that of the center through hole 322 shown in FIGS. 8A to 9B.

Ink flows as shown by the arrows shown in FIG. 10B according to the configuration shown in FIG. 10A, so that the ink is supplied from the ink cartridge 200 to the printer 100 through the cavernous material 326 and the through hole 322. In addition, the remaining ink within ink path 311 and the inner space 310*a* is held by the cavernous material 326 and the through hole 322 due to its surface tension after detaching the ink cartridge 200, under a condition as shown in FIG. 7C. Therefore, leakage of the ink can be prevented.

According to the present embodiment (and the modified examples), the remaining ink within the joint section 313 of the cartridge holder 310 can be held therein because the anti-outflow member 320 slides toward the edge of the joint section 313 of the cartridge holder 310 with being contacting with the joint section 232 of the ink supply port 230 while the ink cartridge 200 is detached from the printer 100. Therefore, the remaining ink within ink path 311 and the inner space 310*a* can be held by the anti-outflow member 320. Especially, since the insertion rod 312 can function to open the ink flow path 230*a* by pushing the inner stopper 231 and to guide the anti-outflow member 320 sliding, ink can be firmly guided to flow into the joint section 313 of the cartridge holder 310 through the ink flow path 230*a* and ink leakage from the joint section 313 after detaching the ink cartridge 200 can be prevented firmly.

Therefore, ink leakage from an opening of the joint section 313 of the cartridge holder 310 can be prevented when the ink cartridge 200 is attached-to or detached-from the printer 100 such as an inkjet type printer according to the present embodiment (and the modified examples).

Note that one end of the spring 315 is fixed with the anti-outflow member 320 and another end of the spring 315 is fixed with the cartridge holder 310 to prevent the anti-outflow member 320 from dropping off. Alternatively, a retaining circular plate may be provided (e.g., by being attached or integrally formed) at the distal end of the insertion rod 312 to prevent the anti-outflow member 320 from dropping off. The retaining plate has an outer diameter larger than the center through hole 322 but does not hide the through holes 323 or 324.

What is claimed is:

1. A detachable structure for an ink cartridge which is detachable with a printer, the structure comprising:

an ink supply port provided in the ink cartridge for supplying ink to the printer;

an inner stopper provided in the ink supply port, the inner stopper being pressed outward due to an inner pressure of the ink cartridge to close the ink supply port;

a joint section provided in the printer, the joint section being coupled with the ink supply port to engage the ink supply port and having an ink flow path within the joint section that communicates with the ink supply port while the ink supply port is coupled the joint section;

an insertion rod provided in the joint section for pushing the inner stopper into an inside of the ink supply port to communicate the ink flow path with the ink supply port while the ink supply port is coupled with the joint section; and an anti-outflow member slidably provided in the joint section, the anti-outflow member being urged toward an outside of the joint section and sliding along the insertion rod when the ink supply port is being inserted into the joint section so that, during withdrawal of the ink cartridge from the joint section, the anti-outflow member presses against the ink supply port, the anti-outflow member including a plate having an outer shape corresponding to an inner shape of the ink flow path.

2. The detachable structure for an ink cartridge according to claim 1, wherein the anti-outflow member includes a plurality of through holes formed on the plate.

3. The detachable structure for an ink cartridge according to claim 1, wherein the anti-outflow member includes an insertion hole having an inner diameter larger than the an outer diameter of the insertion rod to make an ink flow path between the plate and the insertion rod.

4. The detachable structure for an ink cartridge according to claim 1, wherein the anti-outflow member comprises ink-permeable cavernous material.

5. A detachable structure for an ink cartridge which is detachable with a printer, the structure comprising:

an ink supply port provided in the ink cartridge for supplying ink to the printer;

an inner stopper provided in the ink supply port, the inner stopper being pressed outward due to an inner pressure of the ink cartridge to close the ink supply port;

a joint section provided in the printer, the joint section being coupled with the ink supply port to engage the ink supply port and having an ink flow path within the joint section that communicates with the ink supply port while the ink supply port is coupled the joint section;

an insertion rod provided in the joint section for pushing the inner stopper into an inside of the ink supply port to communicate the ink flow path with the ink supply port while the ink supply port is coupled with the joint section; and an anti-outflow member slidably provided in the joint section, the anti-outflow member being urged toward an outside of the joint section and sliding along the insertion rod when the ink supply port is being inserted into the joint section, wherein the anti-outflow member includes a plate having an outer shape corresponding to an inner shape of the ink flow path, a plurality of through holes provided on an outer circumference of the plate formed on the plate and a plurality of bumps provided on one surface of the plate that faces the ink supply port.

6. A printer having at least one joint section for coupling with a detachable ink cartridge, the printer comprising:

a joint section provided in the printer, the joint section coupling with the ink supply port to engage an ink supply port in an ink supply cartridge, the joint section engaging an inner stopper in the ink supply port, and pressing the inner stopper outward due to an inner pressure of the ink cartridge to close the ink supply port;

the joint section having an ink flow path within the joint section that communicates with the ink supply port while the joint section engages the ink supply port;

an insertion rod provided in the joint section for pushing the inner stopper into an inside of the ink supply port to communicate the ink flow path with the ink supply port while the joint section engages the ink supply port; and an anti-outflow member slidably provided in the joint section, the anti-outflow member urged toward an outside of the joint section and sliding along the insertion rod when the joint section engages the ink supply port so that, during withdrawal of the ink cartridge from the joint section, the anti-outflow member presses against the ink supply port, wherein the anti-outflow member includes a plate having an outer shape corresponding to an inner shape of the ink flow path and an insertion hole having an inner diameter larger than the an outer diameter of the insertion rod to establish an ink flow path between the plate and the insertion rod.

7. The printer according to claim 6, wherein the anti-outflow member includes a plurality of through holes formed on the plate.

8. The printer according to claim 6, wherein the anti-outflow member includes an insertion hole having an inner diameter larger than the an outer diameter of the insertion rod to make an ink flow path between the plate and the insertion rod.

9. The printer according to claim 6, wherein the anti-outflow member includes a plurality of through holes provided on an outer circumference of the plate formed on the plate and a plurality of bumps provided on one surface of the plate that faces the ink supply port.

10. The printer according to claim 6, wherein the anti-outflow member comprises ink-permeable cavernous material.

* * * * *